US006565236B1

(12) United States Patent
Davis, Jr.

(10) Patent No.: US 6,565,236 B1
(45) Date of Patent: May 20, 2003

(54) THROUGH WALL LIGHT FIXTURE

(76) Inventor: Frank H. Davis, Jr., P.O. Box 214, Pinehurst, NC (US) 28370

( * ) Notice: Subject to any disclaimer, the term of this patent is extended or adjusted under 35 U.S.C. 154(b) by 53 days.

(21) Appl. No.: 09/960,199

(22) Filed: Sep. 21, 2001

(51) Int. Cl.[7] ..... F21V 21/02
(52) U.S. Cl. ..... 362/362; 362/364; 362/147
(58) Field of Search ..... 362/95, 125, 147, 362/153, 362, 364, 365, 367, 152, 146, 153.1, 267, 310, 374, 375; 206/463, 485

(56) References Cited

U.S. PATENT DOCUMENTS 3,842,320 A 10/1974 Kiesling
4,223,377 A * 9/1980 Williams ..... 362/145
4,755,913 A 7/1988 Sleveland
4,924,349 A 5/1990 Buehler et al.
5,006,967 A 4/1991 Diamond
5,038,542 A * 8/1991 Kline ..... 40/545
5,107,637 A * 4/1992 Robbins ..... 136/291
D330,267 S 10/1992 Hendrix
5,544,025 A 8/1996 Bohlool et al.
5,984,487 A * 11/1999 McGhee ..... 280/288.4
6,185,888 B1 * 2/2001 Wasson ..... 256/19

* cited by examiner

*Primary Examiner*—Thomas M. Sember
*Assistant Examiner*—John Amarantides

(57) ABSTRACT

A through wall light fixture for illuminating areas on either side of a wall includes a housing designed for being installed inside the interior portion of a wall with the ends flush with the outer wall surfaces. A light fixture is positioned within the housing with plate members being selectively couplable to the housing ends. A variety of lenses are selectively couplable to the plate members thereby allowing the user to way the area outside each wall is illuminated.

12 Claims, 2 Drawing Sheets

THROUGH WALL LIGHT FIXTURE

BACKGROUND OF THE INVENTION

1. Field of the Invention

The present invention relates to light fixtures and more particularly pertains to a new through wall light fixture for illuminating areas on either side of a wall.

2. Description of the Prior Art

The use of light fixtures is known in the prior art. More specifically, light fixtures heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,924,349; U.S. Pat. No. 4,755,913; U.S. Pat. No. Des. 330,267; U.S. Pat. No. 3,842,320; U.S. Pat. No. 5,006,967; and U.S. Pat. No. 5,544,025.

While these devices fulfill their respective, particular objectives and requirements, the aforementioned patents do not disclose a new through wall light fixture. The inventive device includes a housing designed for being installed inside the interior portion of a wall with the ends flush with the outer wall surfaces. A light fixture is positioned within the housing with plate members being selectively couplable to the housing ends. A variety of lenses are selectively couplable to the plate members thereby allowing the user to way the area outside each wall is illuminated.

In these respects, the through wall light fixture according to the present invention substantially departs from the conventional concepts and designs of the prior art, and in so doing provides an apparatus primarily developed for the purpose of illuminating areas on either side of a wall.

SUMMARY OF THE INVENTION

In view of the foregoing disadvantages inherent in the known types of light fixtures now present in the prior art, the present invention provides a new through wall light fixture construction wherein the same can be utilized for illuminating areas on either side of a wall.

The general purpose of the present invention, which will be described subsequently in greater detail, is to provide a new through wall light fixture apparatus and method which has many of the advantages of the light fixtures mentioned heretofore and many novel features that result in a new through wall light fixture which is not anticipated, rendered obvious, suggested, or even implied by any of the prior art light fixtures, either alone or in any combination thereof.

To attain this, the present invention generally comprises a housing designed for being installed inside the interior portion of a wall with the ends flush with the outer wall surfaces. A light fixture is positioned within the housing with plate members being selectively couplable to the housing ends. A variety of lenses are selectively couplable to the plate members thereby allowing the user to way the area outside each wall is illuminated.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new through wall light fixture apparatus and method which has many of the advantages of the light fixtures mentioned heretofore and many novel features that result in a new through wall light fixture which is not anticipated, rendered obvious, suggested, or even implied by any of the prior art light fixtures, either alone or in any combination thereof.

It is another object of the present invention to provide a new through wall light fixture which may be easily and efficiently manufactured and marketed.

It is a further object of the present invention to provide a new through wall light fixture which is of a durable and reliable construction.

An even further object of the present invention is to provide a new through wall light fixture which is susceptible of a low cost of manufacture with regard to both materials and labor, and which accordingly is then susceptible of low prices of sale to the consuming public, thereby making such through wall light fixture economically available to the buying public.

Still yet another object of the present invention is to provide a new through wall light fixture which provides in the apparatuses and methods of the prior art some of the advantages thereof, while simultaneously overcoming some of the disadvantages normally associated therewith.

Still another object of the present invention is to provide a new through wall light fixture for illuminating areas on either side of a wall.

Yet another object of the present invention is to provide a new through wall light fixture which includes a housing designed for being installed inside the interior portion of a wall with the ends flush with the outer wall surfaces. A light fixture is positioned within the housing with plate members being selectively couplable to the housing ends. A variety of lenses are selectively couplable to the plate members thereby allowing the user to way the area outside each wall is illuminated.

Still yet another object of the present invention is to provide a new through wall light fixture that is capable of lighting two separate areas utilizing one light fixture.

Even still another object of the present invention is to provide a new through wall light fixture that allows the user to vary the type of light cast on either side of the wall the unit is installed in.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
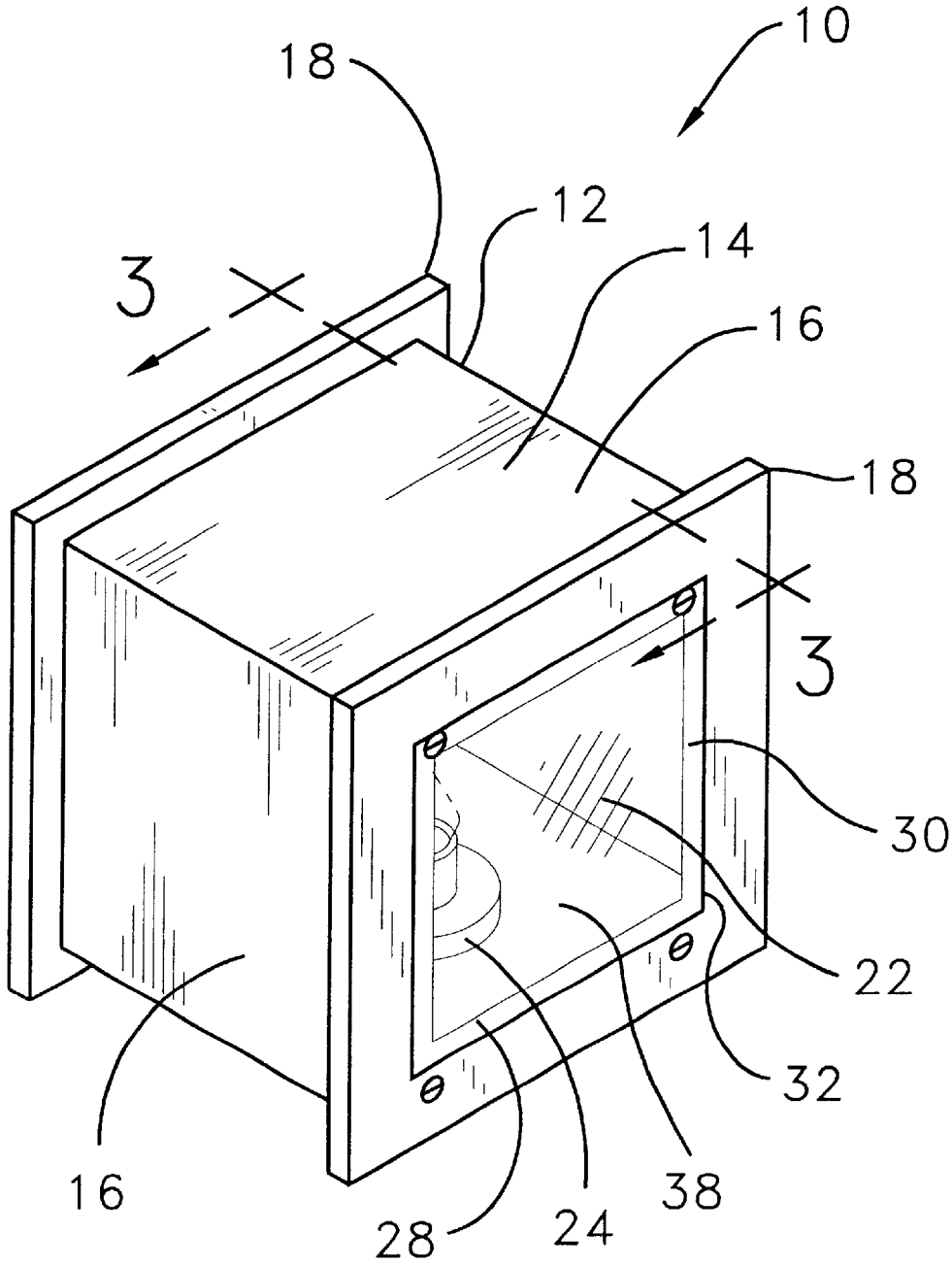
FIG. 1 is a perspective view of a new through wall light fixture according to the present invention.
Figure 2:
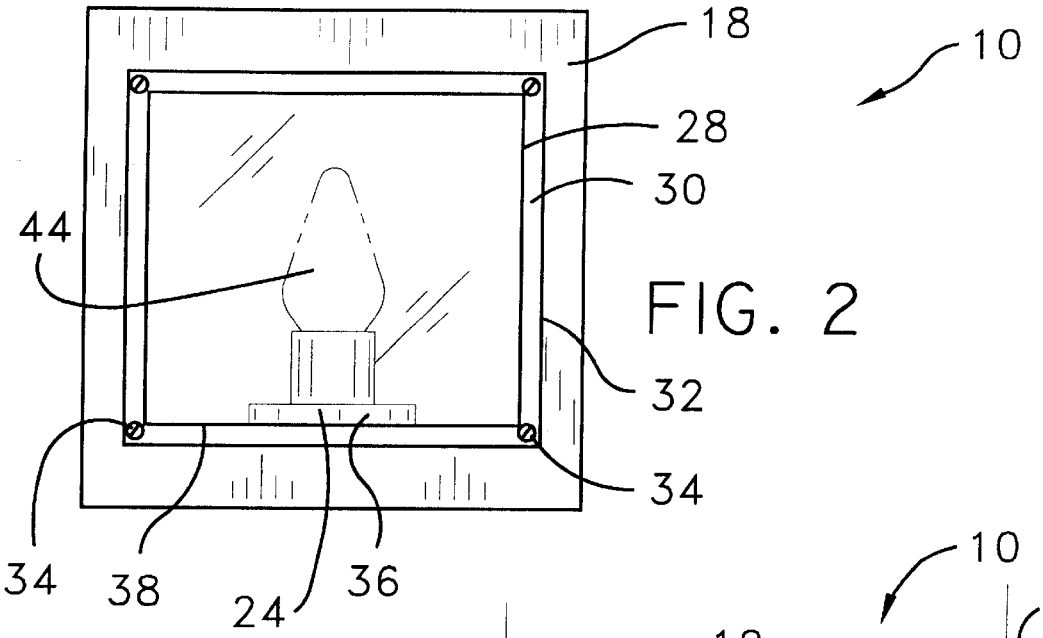
FIG. 2 is an end view of the present invention.
Figure 3:
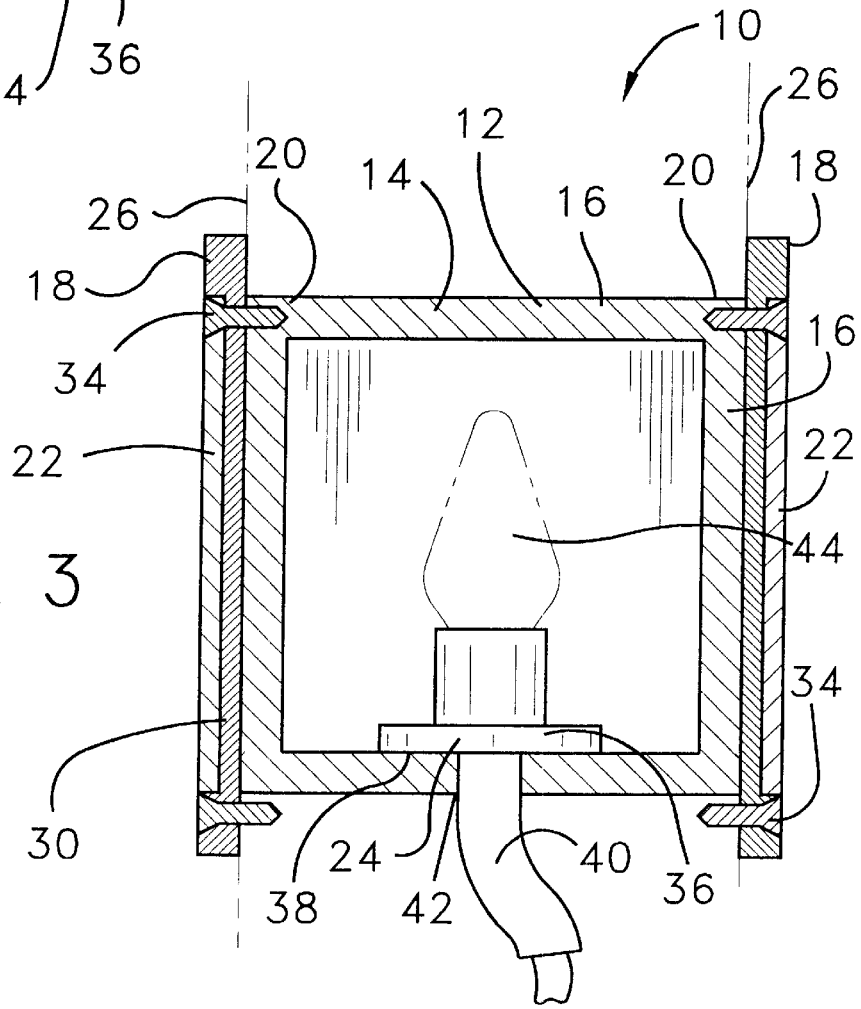
FIG. 3 is a cross-sectional side view of the present invention.

With reference now to the drawings, and in particular to FIGS. 1 through 3 thereof, a new through wall light fixture embodying the principles and concepts of the present invention and generally designated by the reference numeral 10 will be described.

As best illustrated in FIGS. 1 through 3, the through wall light fixture 10 generally comprises a housing 12. The housing 12 includes a box portion 14. The box portion 14 comprises a plurality of surface members 16 such that the box portion 14 has a substantially square-shaped cross-section.

A plurality of end plate members 18 is selectively couplable to end portions 20 of the box portion 14. Each of the end plate members 18 includes a lens member 22. The lens members 22 are designed for allowing light from a light fixture 24 to be emitted outwardly.

The housing 12 is positionable between outer wall surfaces 26 such that the light is emitted outwardly thereby illuminating the areas on both sides of the outer wall surfaces 26.

The housing 12 has a longitudinal length equal to a dimension between the outer wall surfaces 26.

The end plate members 18 are substantially larger than the end portions 20 of the box portion 14 of the housing 12 such that the end plate members 18 overlap the end portions 20 thereby covering the end portions 20 when the housing 12 is positioned between the outer wall surfaces 26 and the end plate members 18 are selectively coupled to the end portions 20.

The end plate members 18 have a light aperture 28. The light aperture 28 is centrally located in the end plate members 18. The end plate members 18 have a plurality of ledge portions 30. The ledge portions 30 are positioned along an outer perimeter 32 of the light aperture 28. The ledge portions 30 are designed for receiving the lens member 22.

The end plate members 18 include a plurality of securing members 34. The securing members 34 protrude through the lens member 22 and the ledge portions 30 such that the securing members 34 are designed for selectively coupling the end plate members 18 to the housing 12.

The lens members 22 of the end plate members 18 comprises a plurality of shades and colors thereby allowing a user to regulate an amount of light being illuminated into each area outside the outer wall surfaces 26.

The light fixture 24 comprises a receptacle member 36. The receptacle member 36 is fixedly coupled to a bottom surface 38 of the box portion 14. The receptacle member 36 includes a cord member 40. The cord member 40 protrudes downwardly through a cord aperture 42 in the bottom surface 38 of the box portion 14 such that the receptacle member 36 is designed for receiving a light bulb 44 for the purpose of illuminating the areas on either side of the wall in which the housing 12 is installed and the cord member 40 is operationally coupled to an electrical supply.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A through wall light fixture for illuminating areas on either side of a wall, the through wall light fixture comprising:

a housing, said housing including a box portion, said box portion comprising a plurality of surface members such that said box portion having a substantially square-shaped cross-section;

a plurality of end plate members being selectively couplable to end portions of said box portion, each of said end plate members including a lens member, said lens members being adapted for allowing light from a light fixture to be emitted outwardly; and said housing being positionable between outer wall surfaces such that the light is emitted outwardly thereby illuminating the areas on both sides of the outer wall surfaces;

said end plate members being substantially larger than said end portions of said box portion of said housing such that said end plate members overlap said end portions thereby covering said end portions when said housing being positioned between the outer wall surfaces and said end plate members being selectively coupled to said end portions.

2. The through wall light fixture as set forth in claim 1, further comprising:

said housing having a longitudinal length equal to a dimension between the outer wall surfaces.

3. The through wall light fixture as set forth in claim 1, further comprising:

said end plate members having a light aperture, said light aperture being centrally located in said end plate members, said end plate members having a plurality of ledge portions, said ledge portions being positioned along an outer perimeter of said light aperture, said ledge portions being adapted for receiving said lens member; and said end plate members including a plurality of securing members, said securing members protruding through said lens member and said ledge portions such that said securing members being adapted for selectively coupling said end plate members to said housing.

4. The through wall light fixture as set forth in claim 1, further comprising:

said lens members of said end plate members comprising a plurality of shades and colors thereby allowing a user to regulate an amount of light being illuminated into each area outside the outer wall surfaces.

5. The through wall light fixture as set forth in claim 1, further comprising:

said light fixture comprising a receptacle member, said receptacle member being fixedly coupled to a bottom surface of said box portion, said receptacle member including a cord member, said cord member protruding downwardly through a cord aperture in said bottom surface of said box portion such that said receptacle member being adapted for receiving a light bulb for the purpose of illuminating the areas on either side of the wall in which said housing being installed and said cord member being operationally coupled to an electrical supply.

6. A through wall light fixture for illuminating areas on either side of a wall, the through wall light fixture comprising:

a housing, said housing including a box portion, said box portion comprising a plurality of surface members such that said box portion having a substantially square-shaped cross-section;

a plurality of end plate members being selectively couplable to end portions of said box portion, each of said end plate members including a lens member, said lens members being adapted for allowing light from a light fixture to be emitted outwardly;

said housing being positionable between outer wall surfaces such that the light is emitted outwardly thereby illuminating the areas on both sides of the outer wall surfaces;

said housing having a longitudinal length equal to a dimension between the outer wall surfaces;

said end plate members being substantially larger than said end portions of said box portion of said housing such that said end plate members overlap said end portions thereby covering said end portions when said housing being positioned between the outer wall surfaces and said end plate members being selectively coupled to said end portions;

said end plate members having a light aperture, said light aperture being centrally located in said end plate members, said end plate members having a plurality of ledge portions, said ledge portions being positioned along an outer perimeter of said light aperture, said ledge portions being adapted for receiving said lens member;

said end plate members including a plurality of securing members, said securing members protruding through said lens member and said ledge portions such that said securing members being adapted for selectively coupling said end plate members to said housing;

said lens members of said end plate members comprising a plurality of shades and colors thereby allowing a user to regulate an amount of light being illuminated into each area outside the outer wall surfaces;

said light fixture comprising a receptacle member, said receptacle member being fixedly coupled to a bottom surface of said box portion, said receptacle member including a cord member, said cord member protruding downwardly through a cord aperture in said bottom surface of said box portion such that said receptacle member being adapted for receiving a light bulb for the purpose of illuminating the areas on either side of the wall in which said housing being installed and said cord member being operationally coupled to an electrical supply.

7. A through wall light fixture for illuminating areas on either side of a wall, the through wall light fixture comprising:

a housing for positioning between outer wall surfaces of the wall, said housing including a box portion comprising a plurality of surface members such that said box portion has a substantially rectangular cross-section;

a light fixture positioned in said housing;

a pair of end plate members being removably coupled to end portions of said box portion, each of said end plate members having a perimeter size larger than a perimeter size of said end portions of said box portion for overlapping adjacent portions of the outer wall surfaces of the wall to retain said housing in the wall.

8. The through wall light fixture as set forth in claim 7 wherein each of said end plate members includes a lens member, each of said lens members being adapted for allowing light from said light fixture to pass through said end plate member on which said lens member is mounted.

9. The through wall light fixture as set forth in claim 7 wherein each of said end plate members has a light aperture, said light aperture being substantially centrally located in said end plate members, said end plate members having a plurality of ledge portions for receiving said lens member, said ledge portions being positioned along an outer perimeter of said light aperture; and said end plate members including a plurality of securing members, said securing members protruding through said lens member and said ledge portions such that said securing members being adapted for selectively coupling said end plate members to said housing.

10. The through wall light fixture as set forth in claim 7 wherein said lens members of said end plate members comprise a plurality of shades and colors for allowing a user to regulate an amount of light being illuminated into each area outside the outer wall surfaces.

11. The through wall light fixture as set forth in claim 7 wherein said light fixture comprises a receptacle member for receiving a light bulb for illuminating areas on either side of the wall in which said housing is installed, said receptacle member being fixedly coupled to a bottom surface of said box portion.

12. The through wall light fixture as set forth in claim 11 wherein said receptacle member includes a cord member for coupling to an electrical supply, said cord member protruding downwardly through a cord aperture in said bottom surface of said box portion.

* * * * *